US007538751B2

(12) United States Patent
Chang et al.

(10) Patent No.: US 7,538,751 B2
(45) Date of Patent: May 26, 2009

(54) METHOD OF RESOLVING DISPLAY DELAY

(75) Inventors: Bou-Chi Chang, Hsinchu (TW); Chang-Ho Liou, Shetou Shiang (TW); Hsin-Mao Huang, Alian Shiang (TW); Chia-Pao Chang, Banqiao (TW)

(73) Assignee: Industrial Technology Research Institute, Hsinchu (TW)

( * ) Notice: Subject to any disclaimer, the term of this patent is extended or adjusted under 35 U.S.C. 154(b) by 403 days.

(21) Appl. No.: 11/074,653

(22) Filed: Mar. 9, 2005

(65) Prior Publication Data

US 2006/0055688 A1 Mar. 16, 2006

(30) Foreign Application Priority Data

Sep. 10, 2004 (TW) ..... 93127380 A

(51) Int. Cl.
*G09G 3/36* (2006.01)

(52) U.S. Cl. ..... 345/87; 345/204

(58) Field of Classification Search ..... 345/87–101, 345/204

See application file for complete search history.

(56) References Cited

U.S. PATENT DOCUMENTS

2005/0078076 A1* 4/2005 Kim et al. ..... 345/98

* cited by examiner

*Primary Examiner*—Bipin Shalwala
*Assistant Examiner*—Kenneth B Lee, Jr.
(74) *Attorney, Agent, or Firm*—WPAT. P.C.; Justin King

(57) ABSTRACT

A method of resolving display delay includes dividing a period of turning on scan lines of an image into at least two sections. At least one section of the period is for charging pixels while pixels are discharged during the other sections of the period for enabling the charging of scan lines (i.e., enabling pixel displaying). The discharging of scan lines (i.e., erasing pixel displaying) is performed a designated number of scan lines apart so as to achieve the purpose of preventing the liquid crystal display from generating display delay and exhibiting an image-sticking phenomena.

2 Claims, 5 Drawing Sheets

Intermittent displayed light method

METHOD OF RESOLVING DISPLAY DELAY

FIELD OF THE INVENTION

The present invention relates to a method of resolving display delay, and more practically, to a method of providing continuous and uninterrupted images during digital image scan for increasing image quality.

BACKGROUND OF THE INVENTION

The appearance and subsequent development of electronic products started only a few decades ago; however, the progressing speed of this industry has surpassed many others. This is especially so in the development of computer related periphery products and video-audio products. New products are ever emerging due to the needs of the working people and recreation needs of the general population. Much progress has been made in these areas; new products are ever emerging. Take the display product for instance; the conventionally used display is constituted of a Cathode Ray Tube (CRT), which usually has the following drawbacks:

1. Since the conventional display is not equipped with flat screen, it is often suffering from a phenomenon of image twisting during watching.
2. The conventional cathode ray tube has comparatively larger power consumption, that is, the cathode ray tube will consume a conceivable more electricity that, as the consequence, the display of cathode ray tube suffers from the phenomena of high temperature and heat.
3. The size of the conventional display is bulky since it is restricted by the size of the cathode ray tube therein, so that a certain larger space is required for storing and operating the conventional display.

New generation of displays including liquid crystal display (LCD), and plasma display, etc, are developed by manufacturers in view of the aforementioned deficiencies of the conventional display. With the maturation of the LCD manufacturing technique, the price of the LCD is decreased to a degree almost equal to that of the conventional display of cathode ray tube. Since the LCD has the advantages of low radiation, low power consumption, small size, and larger visual angle, it is a favorite of mostly common users.

The LCD display nowadays is mostly being implemented as computer monitor, liquid crystal TV, and displaying device and other 3C electronic products, such as mobile phone, digital camera, etc. The LCD provides a widespread application. However, if LCD is applied to the liquid crystal TV in which the conversion of image signal is very fast and the image signal is continuous, a phenomenon of image sticking, as shown in FIG. 1, is generated and seen by human eyes. The happening of image sticking is because that the response time of the liquid crystal display is slower than the TV image signal. It is not easy to significantly improve the response time since it is confined by the properties of the liquid crystal material. In addition, the scan method of the conventional monitor is first to scan a screen horizontally and successively in a single direction, for example, the scanning is performed successively from the topmost end of the screen to the bottommost end of the screen. Next, a step of entirely erasing the image (discharging every pixel of the screen) is performed to black the screen entirely. Following that a scanning of the next image is performed. These steps are performed repeatedly to complete the displaying of liquid crystal display. Nevertheless, the conventional scan method still suffers the image-sticking phenomenon. In view of the above description, the present invention discloses an improved scan method for LCD monitor capable of efficiently eliminating the image-sticking phenomenon.

SUMMARY OF THE INVENTION

In view of the aforementioned drawbacks of the prior art, the present invention discloses a method of resolving display delay. The primary object of the invention is to divide a period of turning on scan lines of an image into at least two sections while charging at least one section of the period and discharging the other section of the period, that is, the charging of scan lines (i.e. enabling pixel displaying) and the discharging of scan lines (i.e. erasing pixel displaying) are performed with a designated number of scan lines apart, such that the purpose of preventing the liquid crystal display from generating display delay and image-sticking phenomena can be achieved.

According to above principle, when an LCD is scanning, the charging and the discharging are performed at an interval of at least one-third through one-half of an image, so that the purpose of preventing the liquid crystal display from generating display delay and image-sticking phenomena can be achieved.

The following descriptions of drawings and preferred embodiment could be taken in conjunction with the accompanying auxiliary drawings to specifically explain the present invention and facilitate examiner to examine the present invention.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

Figure 1:
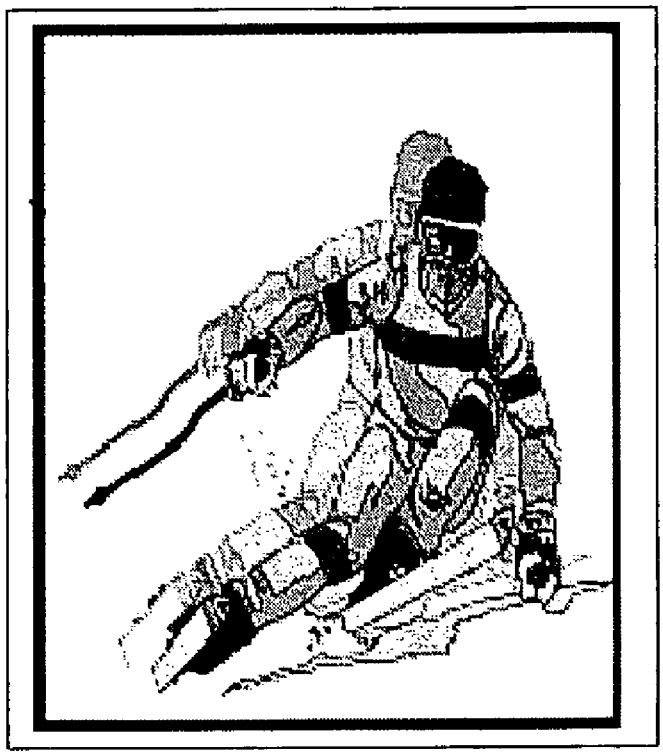
FIG. 1 (PRIOR ART)
FIG. 1 is a schematic representation showing the image-sticking phenomenon of the conventional liquid crystal display.
Figure 1:
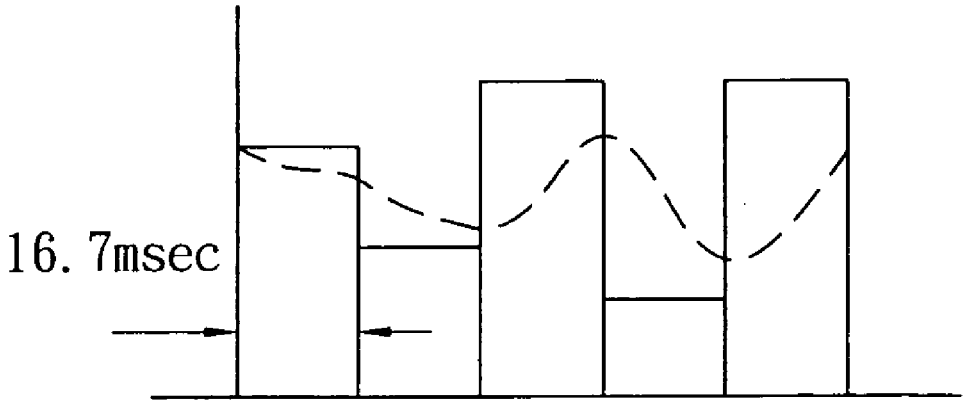
FIG. 1 (PRIOR ART)
Figure 2:
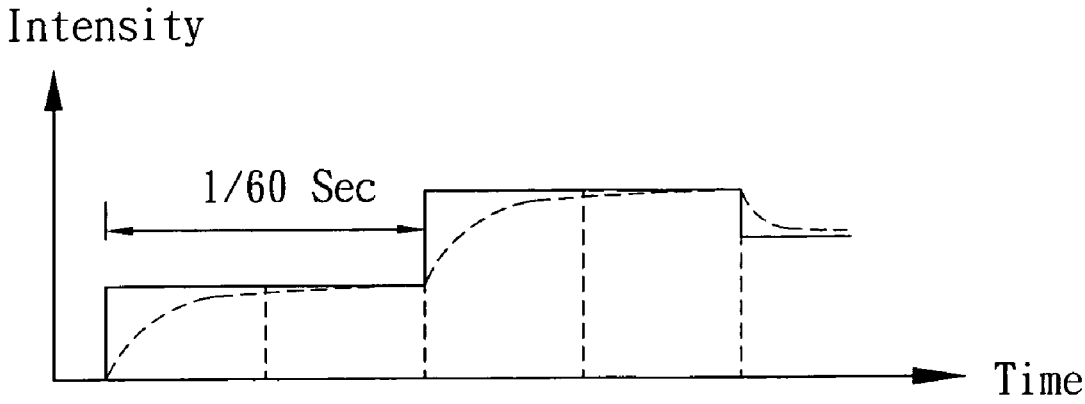
FIG. 2 is a waveform of hold-type displaying for LCDs according to the present invention.
Figure 3:
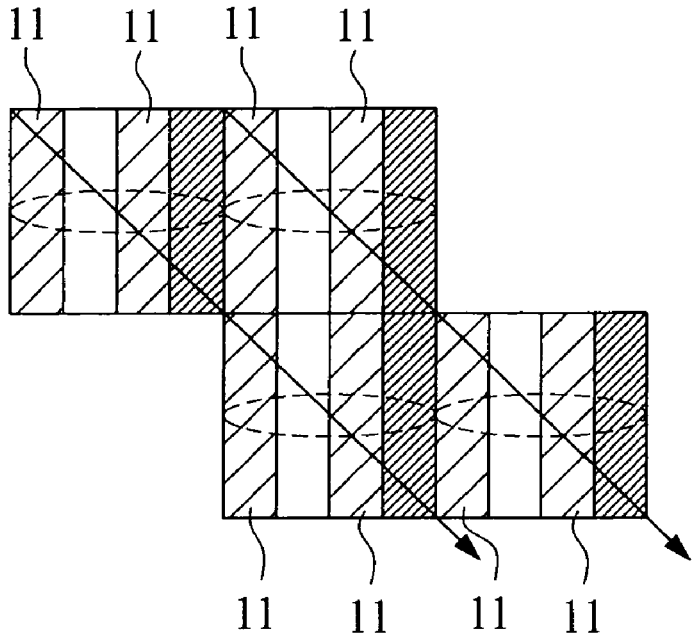
FIG. 3 is a schematic illustration showing a mechanism of motion for LCDs according to the present invention.

Referring to FIG. 2, which is a waveform of hold-type displaying for LCDs according to the present invention. As seen in FIG. 2, the profile is a period curve of a scan line without intermittent displayed light. Referring to FIG. 3, which is a schematic illustration showing a mechanism of motion for LCDs according to the present invention. As seen in FIG. 3, it is the image displayed corresponding to the screen line period of the FIG. 2, wherein each field is composed of a plurality of single pixels 11 and the image is formed by a continue scanning that the image is formed by first scanning a screen horizontally and successively in a single direction, for example, the scanning is performed successively from the topmost end of the screen to the bottommost end of the screen, and then erasing the entire image (discharging every pixel of the screen) to black the screen entirely, and following that a scanning of the next image is performed. These steps are performed repeatedly to complete the displaying of liquid crystal display. Nevertheless, the conventional scan method still suffers the image-sticking phenomenon. Therefore, a method for resolving this deficiency is disclosed hereinafter.

Figure 4:
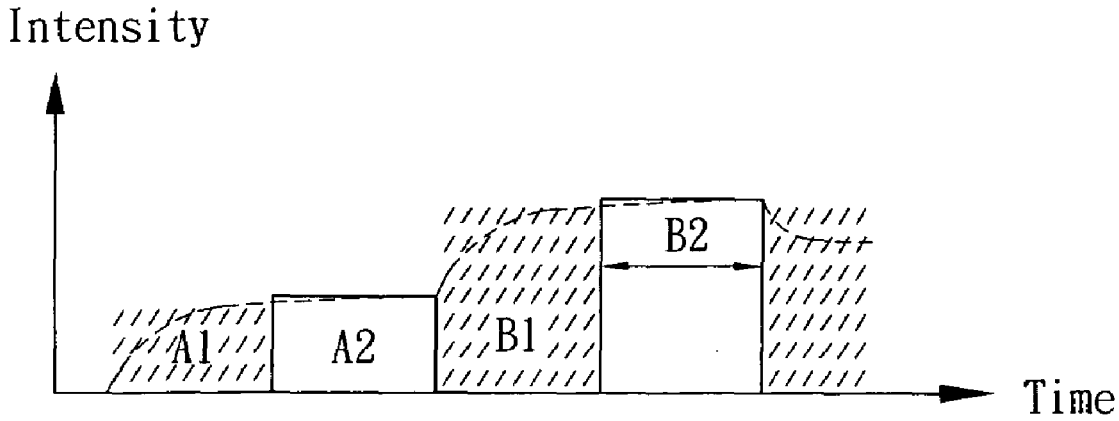
FIG. 4 shows an intermittent displayed light method for LCDs according to the present invention.
Figure 5:
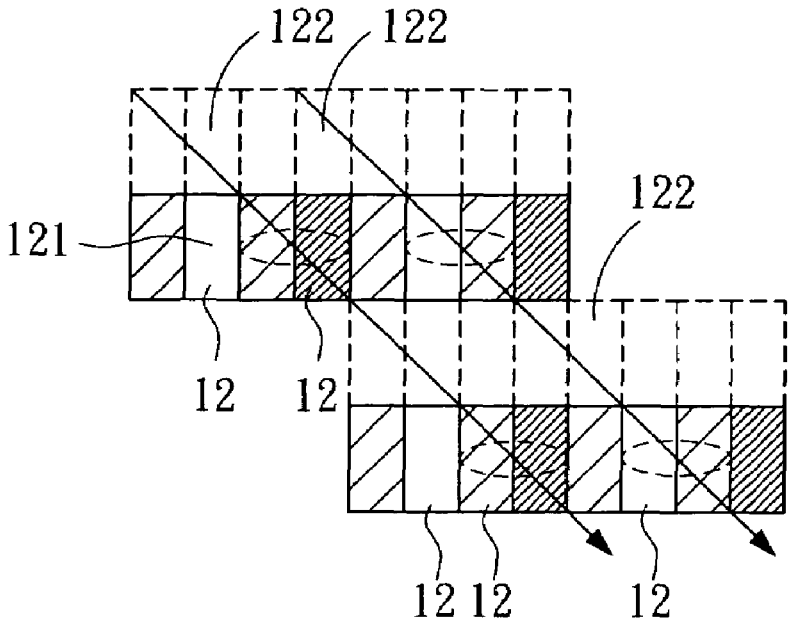
FIG. 5 a schematic illustration showing a mechanism of motion for LCDs improved by the intermittent displayed light method with accordance to the present invention.

Referring to FIG. 4, an intermittent displayed light method for LCDs according to the present invention is shown. As seen in FIG. 4, the method comprising the steps of: dividing a period of turning on scan lines of an image is into at least two sections, i.e. a first obstructing area A1 and a first displaying area A2, or a second obstructing area B1 and a second displaying area B2; charging at least one section of the period, e.g. A2 and B2, while discharging the other sections of the period, i.e. A1 and B1, for enabling the charging of scan lines (i.e. enabling pixel displaying) and the discharging of scan lines (i.e. erasing pixel displaying) are performed with a designated number of scan lines apart, such that the purpose of preventing the liquid crystal display from generating display delay and image-sticking phenomena can be achieved. The result of adopting the method of FIG. 4 is shown in FIG. 5, wherein a single pixel 12 of every field is divided into a displayed pixel 121 and an undisplayed pixel 122 so as to efficiently improve the image-sticking phenomenon.

Figure 6:
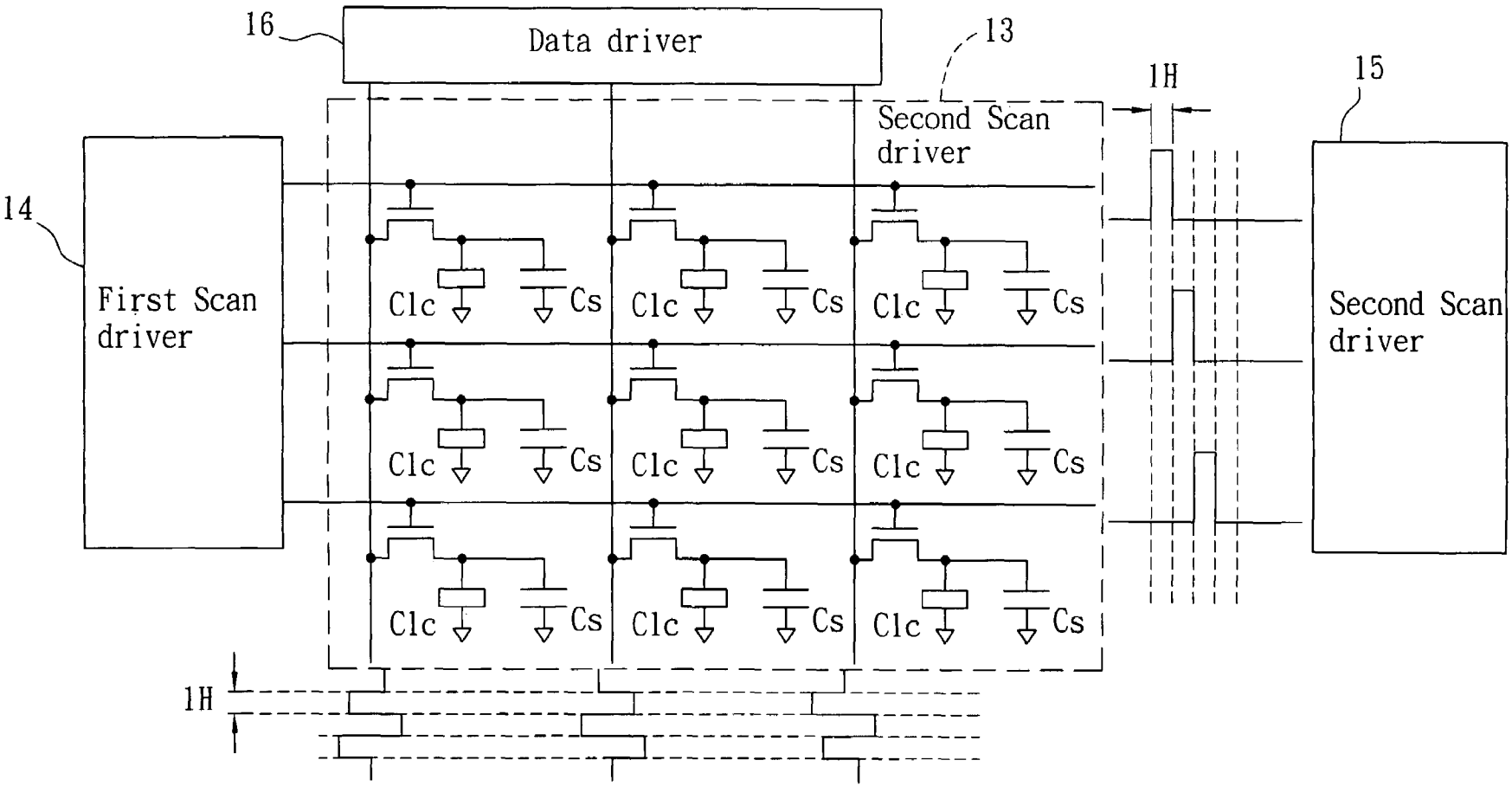
FIG. 6 is a driving circuit of the present invention
Figures 7A, 7B:
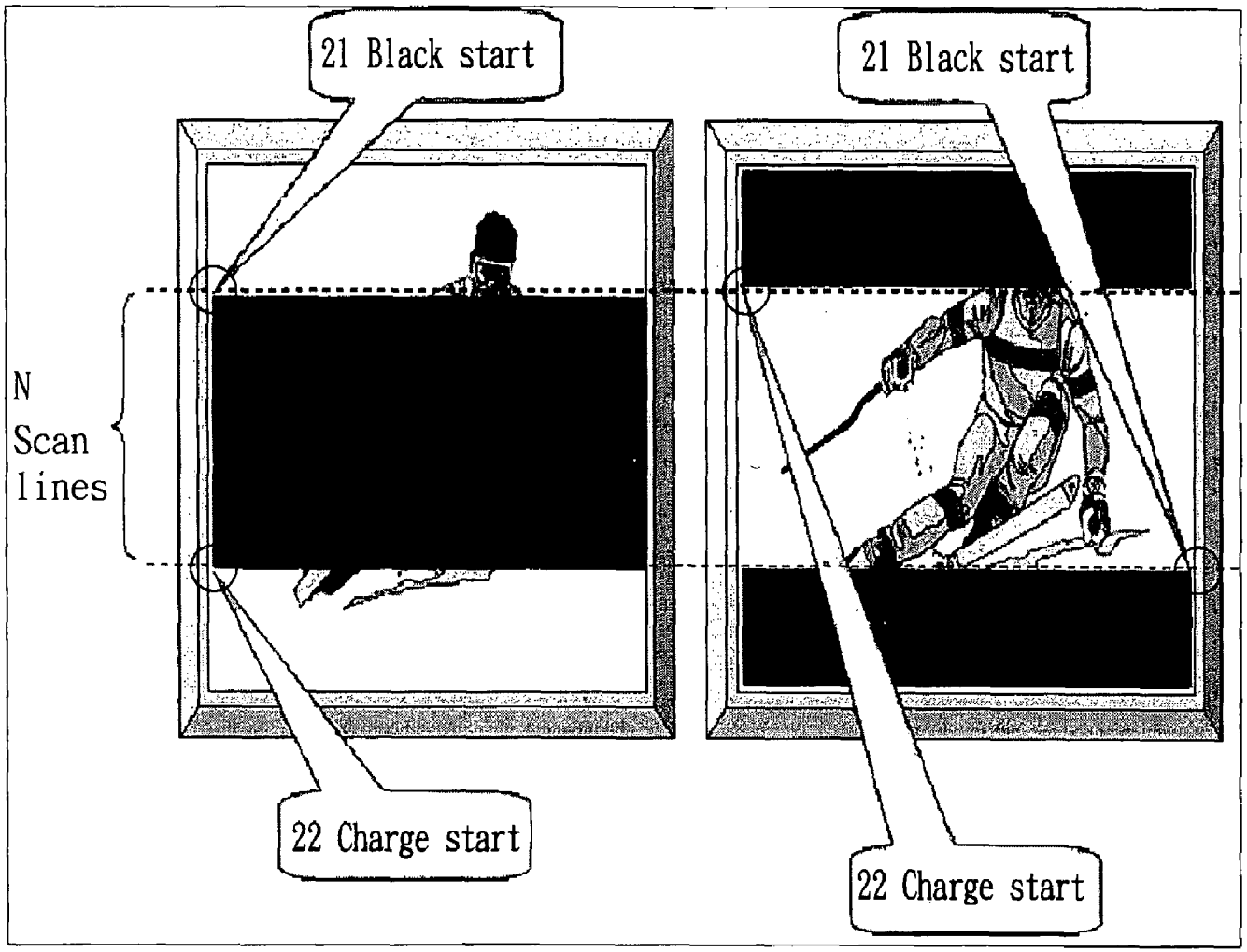
FIG. 7A is a diagram showing a first movement of the scan lines for LCDs according to the present invention.
FIG. 7B is a diagram showing a second movement of the scan lines for LCDs according to the present invention.

Referring to FIG. 6, a driving circuit of the present invention is shown. As seen in FIG. 6, pixel capacitors 13 are applied for charging/discharging pixels. In this preferred embodiment, the left side and the right side of the plural pixel capacitors 13 are connected respectively to a first scan driver 14 and a second scan driver 15, wherein these two scan drivers are applied to display pixel or erase pixel, and to maintain the pixel displaying of the screen or the pixel erasing of the screen to hold a difference of one-half or one-third of the screen, in addition, these two scan drivers are applied for controlling the signal output of horizontal scan lines. Moreover, a data driver 16 is mounted on the top of the plural pixel capacitors 13 so as to control the signal output of each pixel capacitor 13. In this preferred embodiment, when an LCD is scanning, the charging and the discharging are performed at an interval of at least one-third through one-half of an image, or at any interval at will. As seen in FIG. 7A and FIG. 7B, the interval between black start 21 and charge start 22 is one-half the displaying screen. As a result, the image-sticking phenomenon is effectively improved.

According to the disclosure of FIG. 2 through FIG. 7B, it is understood that the present invention can divide a period of turning on scan lines of an image into at least two sections while charging at least one section of the period and discharging the other section of the period, that is, the charging of scan lines (i.e. enabling pixel displaying) and the discharging of scan lines (i.e. erasing pixel displaying) are performed with a designated number of scan lines apart, such that the purpose of preventing the liquid crystal display from generating display delay and image-sticking phenomena can be achieved. In addition, when an LCD is scanning, the charging and the discharging are performed at an interval of at least one-third through one-half of an image, so that the purpose of preventing the liquid crystal display from generating display delay and image-sticking phenomena can be achieved.

In summary that this invention has been disclosed and illustrated with reference to particular embodiments, the principles involved are susceptible for use in numerous other embodiments that will be apparent to persons skilled in the art. Consequently, the present invention has been examined to be progressive and has great potential in commercial applications.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A method of resolving display delay, mainly applied to an LCD monitor having a plurality of pixel capacitors arranged therein and coupled to at least a scan driver and a data driver, the method of resolving display delay comprising the steps of:

(a) dividing a period of turning on scan lines of an image is into at least two sections; and (b) charging at least one section of the period while discharging the other sections of the period for enabling the charging of scan lines (i.e. enabling pixel displaying) and the discharging of scan lines (i.e. erasing pixel displaying) are performed with a designated number of scan lines apart so as to prevent the liquid crystal display from generating display delay, wherein the left side and the right side of the plural pixel capacitors are respectively connected to a first scan driver and a second scan driver, and the two scan drivers are used respectively for enabling pixel displaying and erasing pixel displaying, and for maintaining the enabling of pixel displaying and the erasing of pixel displaying to hold an interval of a predetermined number of scan lines, wherein the interval is predetermined, wherein a single pixel of every field is divided into a displayed pixel and an undisplayed pixel so as to efficiently improve the image-sticking phenomena.

2. A circuit of resolving display delay, mainly applied to a LCD monitor, the circuit comprising:

a plurality of pixel capacitors, arranged inside the LCD monitor, each for charging/discharging pixels;

a first scan driver, couple to a side of the plural pixel capacitors, for performing the operation of enabling pixel displaying;

a second scan driver, couple to another side of the plural pixel capacitors corresponding to the first scan driver, for performing the operation of erasing pixel displaying; and a data driver, mounted on top of the plural the pixel capacitors, for controlling the signal output of each pixel capacitor;

wherein the first scan driver and the second scan driver are integrally operated for maintaining the enabling of pixel displaying and the erasing of pixel displaying to hold an interval of a predetermined number of scan lines, and for controlling the signal output of horizontal scan lines, wherein the interval is predetermined, wherein a single pixel of every field is divided into a displayed pixel and an undisplayed pixel so as to efficiently improve the image-sticking phenomena.

* * * * *